US007347675B2

(12) United States Patent
Hasegawa et al.

(10) Patent No.: US 7,347,675 B2
(45) Date of Patent: Mar. 25, 2008

(54) VANE ROTARY EXPANSION ENGINE

(75) Inventors: Hiroshi Hasegawa, Toyonaka (JP); Fumitoshi Nishiwaki, Nishinomiya (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 237 days.

(21) Appl. No.: 10/511,310

(22) PCT Filed: Apr. 17, 2003

(86) PCT No.: PCT/JP03/04928

§ 371 (c)(1),
(2), (4) Date: Oct. 15, 2004

(87) PCT Pub. No.: WO03/089766

PCT Pub. Date: Oct. 30, 2003

(65) Prior Publication Data

US 2005/0158199 A1 Jul. 21, 2005

(30) Foreign Application Priority Data

Apr. 19, 2002 (JP) ..... 2002-117520

(51) Int. Cl.
*F03C 2/00* (2006.01)
*F04C 2/00* (2006.01)

(52) U.S. Cl. ..... 418/15; 418/259; 418/268; 417/295; 417/300

(58) Field of Classification Search ..... 418/15, 418/140, 259, 266–268, 270; 417/295, 300
See application file for complete search history.

(56) References Cited

U.S. PATENT DOCUMENTS

| | | | | |
|---|---|---|---|---|
| 2,463,155 | A * | 3/1949 | Dawes | 418/259 |
| 3,652,191 | A * | 3/1972 | King et al. | 418/125 |
| 3,988,083 | A * | 10/1976 | Shimizu et al. | 418/264 |
| 4,389,170 | A * | 6/1983 | Hayashi | 418/15 |
| 5,947,712 | A * | 9/1999 | Viegas et al. | 418/259 |

FOREIGN PATENT DOCUMENTS

| | | | |
|---|---|---|---|
| DE | 4002506 | A1 * | 5/1990 |
| GB | 2107789 | A * | 5/1983 |
| JP | 57-210101 | | 12/1982 |
| JP | 60-21584 | | 2/1985 |
| JP | 60-60663 | | 4/1985 |
| JP | 60-195901 | | 12/1985 |
| JP | 2001-107881 | | 4/2001 |
| JP | 2001-141315 | | 5/2001 |

* cited by examiner

*Primary Examiner*—Theresa Trieu
(74) *Attorney, Agent, or Firm*—Jordan and Hamburg LLP

(57) ABSTRACT

A high-efficiency vane rotary expander is provided, which prevents a loss due to incomplete expansion or overexpansion from occurring because the volume of an operating chamber may vary. This is done by forming a plurality of discharge ports (28, 29, 48, 49, 50) in an inner wall (21*a*, 41*a*) of a cylinder in the circumferential direction, placing, among these discharge ports, the discharge port (28, 48), to which the operating chamber (25, 45) connects at the initial stage of the discharging process, at a position of {180×(1+1/n)} degrees from a small clearance (22, 42) defined between the cylinder (21, 41) and the rotor (23, 43) in the direction where a shaft rotates, and providing a valve mechanism (30*a*, 30*b*, 51*a*, 51*b*, 52*a*, 52*b*).

20 Claims, 5 Drawing Sheets

PRIOR ART

PRIOR ART

VANE ROTARY EXPANSION ENGINE

TECHNICAL FIELD

The present invention relates to an expander used as a motor which generates rotating power when a high-pressure compressed liquid flows thereinto.

BACKGROUND ART

A vane rotary expander is a kind of displacement type fluid machinery, of which basic structure is disclosed in, for example, Japanese Patent Laid-Open Publication No. 57-210101.

Now, the configuration of the vane rotary expander will be described below. FIG. 4 is a transverse sectional view showing a conventional vane rotary expander. The reference numeral 1 denotes a cylinder having a cylindrical inner wall 1*a*. The cylinder 1 has side plates (not illustrated in the figure) disposed at its both ends. Inside of the cylinder 1, a cylindrical rotor 3 is disposed, and an outer circumferential segment of the cylindrical rotor 3 defines a small clearance 2 together with the inner wall 1*a* of the cylinder 1. The rotor 3 has grooves 3*a* formed perpendicularly to its top and bottom end surfaces at an interval of 90 degrees. Vanes 4 are inserted into the grooves 3 at the respective ends thereof so as to be freely slidable, and the other ends of the vanes 4 are in contact with the inner wall 1*a* of the cylinder 1. An operating chamber 5 is formed at spaces 5*a*, 5*b*, 5*c*, 5*d*, and 5*e* surrounded by the inner wall 1*a* of the cylinder 1, the rotor 3, and the vanes 4. A shaft 6 formed integrally with the rotor 3 is rotatably supported by means of an axis. The cylinder 1 has an intake 7, through which an operating fluid is forced to flow into the operating chamber 5, and a discharge port 8, through which the operating fluid is forced to discharge from the operating chamber 5. Note that the discharge port 8 has an opening portion 8*a*, which opens within a given circumferential range on the inner wall 1*a* of the cylinder 1. Assuming that the number of the vanes 4 is n, the range, where the opening portion 8*a* is formed, starts at a position of $\{180\times(1+1/n)\}$ degrees from the small clearance 2 in the direction where the shaft 6 rotates indicated by an arrow in the figure and ends at a position in the vicinity of the small clearance 2. Note that in FIG. 4, the range of the opening 8*a* starts at a point of 225 degrees from the small clearance 2 because the number of the vanes 4 is four. On the side of the cylinder 1, a cover 9 is attached, inside of which a suction channel 10 for guiding the operating fluid into the intake 7, a discharge chamber 11 for temporarily storing the operating fluid flowing out from the discharge port 8, and a discharge channel 12 for discharging the operating fluid out from the discharge chamber are formed.

Now, focusing on the operating chamber 5, the operation principle of the vane rotary expander will be described below. Initially, the operating chamber is generated in the space 5*a* on the intake 7 side of the small clearance 2. Then, as the rotor 3 rotates, the operating chamber 5 performs a process for sucking the operating fluid from the intake 7 under a pressure Ps on the high-pressure side while increasing its volume, namely a suction process. As soon as the operating chamber 5 reaches the space 5*b*, a communication to the intake 7 is shut off, forming an enclosed space. Thereafter, the operating chamber 5 performs a process for depressurizing the operating fluid contained therein while increasing its volume as the rotor 3 rotates, namely an expansion process. The operating chamber 5 communicates to the opening portion 8*a* of the discharge port 8 immediately after reaching its maximum volume in the space 5*c*. Then, the operating chamber 5 performs a process for discharging the operating fluid into the discharge chamber 11 through the discharge port 8 while decreasing its volume as the rotor 3 rotates, namely a discharging process.

The vane rotary expander rotates the rotor 3 by means of a force exerted on the vane 4, which is generated using a difference in pressure between two adjacent operating chambers 5, while the operating fluid expands and a pressure thereof is depressurized in the expansion process to obtain the power for rotating the shaft 6 integrally formed with the rotor 3.

In the case of a conventional vane rotary expander having the above-mentioned structure, the volume of sucked fluid is equal to the volume Vb of the space 5*b*, where the operating chamber 5 is situated immediately after the suction process ends and the volume of discharged fluid is equal to the volume Vc of the space 5*c*, where the operating chamber 5 is situated immediately before the discharging process begins. Since Vb and Vc are specific to the expanders, a volume ratio (Vb/Vc) remains constant. Assuming that the adiabatic coefficient of the operating fluid is κ, the pressure applied to the space 5*c*, where the operating chamber 5 is situated immediately before the discharging process, is Pc, and the pressure applied to the space 5*b*, where the operating chamber 5 is situated immediately after the suction process, is Ps, the following relational equation (1) is established.

$$Pc=Ps\times(Vb/Vc)^{\kappa} \quad (1)$$

The pressure Pc applied to the space immediately before the discharging process can be found by assigning values to the suction pressure Ps, which is a pressure at the inlet of the expander, and to the volume ratio Vb/Vc, respectively, from the above equation. Since the pressure Pd on the low-pressure side at the outlet of the expander, however, does not always remain constant because it depends on a system where the expander is incorporated. Accordingly, it is assumed that in addition to complete expansion (Pc=Pd), incomplete expansion (Pc>Pd) or overexpansion (Pc<Pd) may occur. FIGS. 5A and 5B are graphs illustrating the P-V relationship for the operating chamber 5. FIG. 5A is a graph illustrating en example of incomplete expansion (Pc>Pd) and FIG. 5B is a graph showing an example of overexpansion (Pc<Pd).

With reference to FIG. 5A, the/example of incomplete expansion (Pc>Pd) will be described below. In the suction process represented by an A-B line in FIG. 5A, the operating chamber 5 sucks the operating fluid through the intake 7 while increasing its volume up to Vb under the suction pressure Ps. In the expansion process represented by a B-C line, the volume of the operating fluid contained in the operating chamber 5 adiabatically expands up to Vc under the pressure Pc. At a point C, the operating chamber 5 is situated in the space 5*c* as shown in FIG. 4 and communicates to the opening portion 8*a* of the discharge port 8 as soon as the rotor 3 rotates by a small distance. At that time, the pressure Pc applied to the operating chamber 5 is higher than the pressure Pd applied to the discharge chamber 11 due to incomplete expansion, forcing the operating fluid to flow into the discharge chamber 11 through the discharge port 8. For this reason, the pressure applied to the operating chamber 5 drops from Pc to Pd while the volume of the operating chamber 5 remains constant, namely Vc. This process is represented by a C-F line shown in FIG. 5A. In the discharging process represented by an F-G line, the operating chamber 5 reduces its volume under the discharge pressure Pd. The power obtained by the expander through the processes mentioned above corresponds to an area ABCFG. On the other hand, the power obtained in the complete expansion (Pc=Pd) process, corresponds to an area ABEG. Accordingly, it may be considered that a loss corresponding to an area CEF due to incomplete expansion has occurred in the expander.

Now, with reference to FIG. 5B, an example of overexpansion (Pc<Pd) will be described below. In the suction process represented by the A-B line, the operating chamber 5 sucks the operating fluid through the intake 7 while increasing its volume up to Vb under the suction pressure Ps. In the expansion process represented by the B-C line, the volume of the operating fluid contained in the operating chamber 5 adiabatically expands up to Vc under the pressure Pc. At the point C, the operating chamber 5 is situated in the space 5C as shown in FIG. 4 and communicates to the opening portion 8*a* of the discharge port 8 as soon as the rotor 3 rotates by a small distance. At that time, the pressure Pc applied to the operating chamber 5 is lower than the pressure Pd applied to the discharge chamber 11 due to overexpansion, forcing the operating fluid to flow back into the operating chamber 5 from the discharge chamber 11 through the discharge port 8. For this reason, the pressure applied to the operating chamber 5 increases from Pc to Pd while the volume of the operating chamber 5 remains constant, namely Vc. This process is represented by a C-H line shown in FIG. 5B. In the discharging process represented by an H-J line, the operating chamber 5 reduces its volume under the discharge pressure Pd. The power obtained by the expander through the suction and expansion processes mentioned above corresponds to an area ABCD. However, since additional power corresponding to an area JHCD is consumed to flow back the operating fluid through overexpansion in the discharging process, the actual power obtained through all the processes is equal to a difference between the powers corresponding to the respective areas ABCD and JHCD. On the other hand, the power obtained in the complete expansion (Pc=Pd) process, corresponds to an area ABIJ. Accordingly, it may be considered that a loss corresponding to an area IHC due to overexpansion has occurred in the expander.

As known from the above descriptions, the conventional vane rotary expanders have a problem in that since a loss due to incomplete expansion or overexpansion is caused because of their volume ratios Vc/Vb being unchanged, they can obtain only the power lower than the power which may be generated by means of the operating fluid in the complete expansion process.

In order to solve the above-mentioned problem involved with the conventional vane rotary expanders, an object of the present invention is to provide a high-efficiency vane rotary expander, wherein a plurality of discharge ports are formed in the circumferential direction on the inner wall of the cylinder and the volume ratio is variable to prevent a loss in power from occurring.

DISCLOSURE OF THE INVENTION

To solve the above-mentioned problem, a vane rotary expander of the present invention includes at least a plurality of operating chambers for expanding a high-pressure operating fluid and a shaft for obtaining a rotating power by means of expansion of the operating fluid in the operating chambers, wherein a plurality of discharge ports comprising a discharge port which firstly communicates to the operating chamber involving in a discharging process and a discharge port which secondly communicates to the same operating chamber are provided, and a valve mechanism for preventing the operating fluid from flowing back is provided at least to the firstly communication discharge port.

Moreover, a vane rotary expander of the present invention including: a cylinder having a cylindrical inner wall; side plates closing its both ends; a rotor disposed in the cylinder, an outer circumferential segment of the rotor defining a small clearance together with the inner wall of the cylinder; vanes inserted into vane grooves formed in the rotor at respective ends thereof so as to be freely slidable, the other ends of the vanes sliding against an inner wall of the cylinder to form a plurality of operating chambers between the cylinder and the rotor; and a shaft integrally formed with the rotor, the shaft being rotatably supported by means of an axis; obtains a power for rotating the shaft by expanding a high-pressure operating fluid in the operating chamber, comprising: a plurality of discharge ports having a discharge port which firstly communicates to the operating chamber involving in a discharging process and a discharge port which secondly communicates to the same operating chamber, both being provided in a circumferential direction of the cylinder; and a valve mechanism preventing the operating fluid from flowing back being provided at least to the firstly communicating discharge port.

Further, in the vane rotary expander of the present invention, when the number of the vanes is n, the firstly communicating discharge port is formed in the cylinder at a position of approximate $\{180\times(1+1/n)\}$ degrees from the small clearance in a direction where the shaft rotates, and the succeedingly communicating discharge port is formed in the cylinder at any position in an area from an angle of approximate $\{180\times(1+1/n)\}$ degrees to an angle of 360 degrees from the small clearance in the direction where the shaft rotates.

Additionally, in the vane rotary expander of the present invention, a central angle around the shaft on the cylinder between the firstly communicating discharge port and the succeeding communicating discharge port and/or between the succeeding communicating discharge ports is smaller than or equal to (360/n) degrees.

Furthermore, the vane rotary expander of the present invention is operated by means of an operating fluid expanding into a gas-liquid two phase from a liquid phase or a supercritical phase.

In addition, the vane rotary expander of the present invention is operated by means of an operating fluid containing carbon dioxide as a main component.

BEST MODE FOR CARRYING OUT THE INVENTION

Now, the embodiments of the present invention will be described below with reference to the accompanying drawings.

FIRST EMBODIMENT

Figure 1:
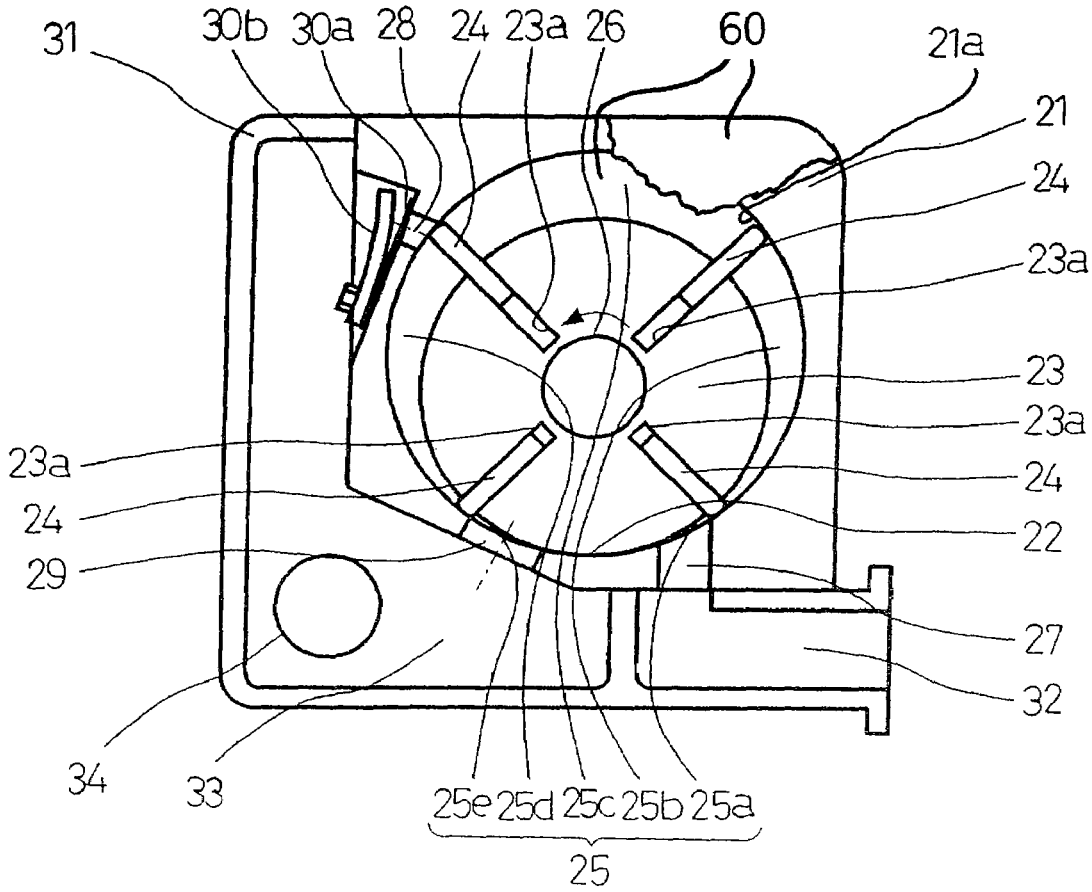
FIG. 1 is a transverse sectional view of a vane rotary expander according to a first embodiment of the present invention.

FIG. 1 is a transverse sectional view of a vane rotary expander according to a first embodiment of the present invention. The reference numeral 21 denotes a cylinder having a cylindrical inner wall 21*a*. The cylinder also has side plates 60 (a forwardmost one being shown cutaway) disposed at ends. Inside the cylinder 21, a cylindrical rotor 23 is disposed, and an outer circumferential segment of said cylindrical rotor 23 defines a small clearance 22 together with the inner wall 21*a* of the cylinder 21. The rotor 23 has grooves 23*a* formed perpendicularly to its top and bottom end surfaces at an interval of 90 degrees. Vanes 24 are inserted into the grooves 23*a* at the respective ends thereof so as to be freely slidable, and the other ends of the vanes 24 are in contact with the inner wall 21*a* of the cylinder 21. An operating chamber 25 is formed at spaces 25*a*, 25*b*, 25*c*, 25*d*, and 25*e* surrounded by the inner wall 21*a* of the cylinder 21, the rotor 23, and the vanes 4. A shaft 26 formed integrally with the rotor 23 is rotatably supported about an axis. The cylinder 21 has an intake 27, through which an operating fluid is forced to flow into the operating chamber 25, and a first discharge port 28 and a second discharge port 29 for flowing the operating fluid out from the operating chamber 25 are formed in the cylinder 21. Assuming that the number of the vanes 24 is n, the first discharge port 28 is formed at a position of $\{180\times(1+1/n)\}$ degrees from the small clearance (a position where the clearance defined between the rotor 23 and the inner wall 21*a* of the cylinder becomes smallest) 22 in a direction where the shaft 26 rotates, as indicated by an arrow. In FIG. 1, the discharge port 28 is positioned at 225 degrees because the number of the vanes 24 is four. In addition, the first discharge port 28 is provided with a valve mechanism comprising a reed valve 30*a* and a valve stop 30*b* incorporated. The second discharge port 29 has been formed in the vicinity of the small clearance 22 and has such a shape that its part contains an area from the small clearance 22 to a position of 315 degrees in the direction where the shaft 26 rotates with no valve mechanism. Note that the position of the second discharge port 29 is not limited to those as described above and such a configuration is accepted that a central angle defined around the shaft 26 on the inner wall 21*a* of the cylinder 21 between the first and second discharge ports 28 and 29 is smaller than or equal to (360/n) degrees assuming that the number of the vanes 24 is n and the second discharge port 29 contains an area in the vicinity of the small clearance 22.

The intake 27 is formed at a position where a relational equation (2) is established between the volume Vb of the space 25*b*, where the operating chamber 25 is situated at the end of the suction process and the volume Vc of the space 25*c*, where the operating chamber 25 is situated when reaching its maximum volume, using the maximum value Rmax for an expansion ratio expected for the system in which the expander is incorporated and an adiabatic coefficient κ for the operating fluid.

$$Vb=Vc\times(1/R\max)^{1/\kappa} \quad (2)$$

Note that the volume Vb of the space 25*b*, where the operating chamber 25 is situated at the end of the suction process, decreases as the position of the intake 27 comes close to the small clearance 22, while it increases as it goes away from the small clearance 22. By forming the intake 27 at the position satisfying the above-mentioned equation (2), incomplete expansion (Pc>Pd) is prevented from occurring, allowing for constant overexpansion (Pc<Pd).

On the side of the cylinder 21, a cover 31 is attached, inside which a suction channel 32 for guiding the operating fluid into the intake 27, a discharge chamber 33 for temporarily storing the operating fluid flowing out from the first and second discharge ports 28 and 29, and a discharge channel 34 for flowing the operating fluid out from the discharge chamber 33 are formed.

Figure 2:
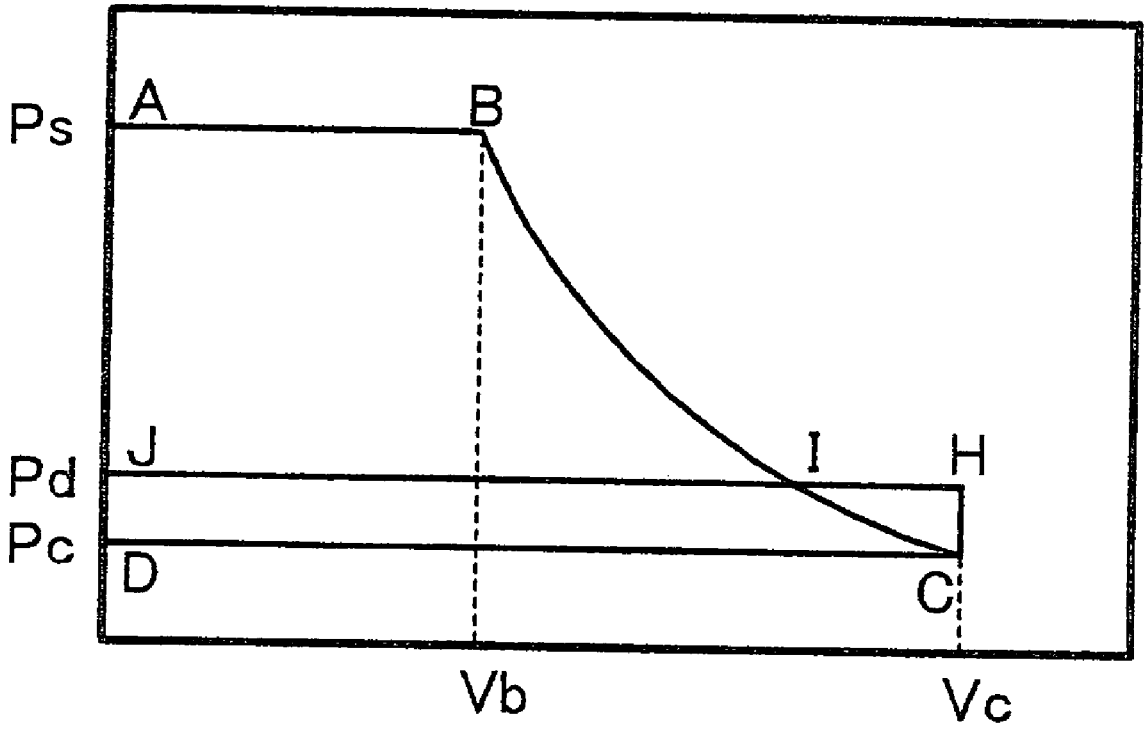
FIG. 2 is a graph showing the P-V relationship for the operating chamber of the vane rotary expander according to the first embodiment of the present invention.

Now, focusing on the operating chamber 25, the operation principle of the vane rotary expander according to the present embodiment will be described below. FIG. 2 is a graph showing a P-V relationship for the operating chamber 25 of the vane rotary expander according to the first embodiment. Initially, the operating chamber 25 is situated in the space 25*a* on the intake 27 side of the small clearance 22. Then, as the rotor 23 rotates, the operating chamber 25 performs a process for sucking the operating fluid through the intake 27 under a pressure Ps on the high-pressure side while increasing its volume, namely a suction process. The suction process is represented by an A-B line in FIG. 2. As soon as the operating chamber 25 reaches the space 25*b*, a communication to the intake 27 is shut off, forming an enclosed space. Thereafter, the operating chamber 25 performs a process for depressurizing the operating fluid contained therein while increasing its volume as the rotor 23 rotates, namely an expansion process. A B-C line in FIG. 2 represents the expansion process. The volume of the operating chamber 25 reaches its maximum value at the position of the space 25*c*.

At this point corresponding to C in FIG. 2, overexpansion occurs where the pressure Pc applied to the operating chamber 25 is lower than the discharge pressure Pd. As soon as the rotor 23 moves by a small distance, the operating chamber 25 situated in the space 25*c* communicates to the first discharge port 28. At that time, if no reed valve 30*a* has been attached to the first discharge port 28, the operating fluid flows into the operating chamber 25 from the discharge chamber 33 under the pressure Pd and the pressure applied to the operating chamber 25 increases up to Pd from Pc while the volume of the operating chamber 25 remains constant, namely Vc. As shown in FIG. 2, the process proceeds from C to H. On the other hand, since the vane rotary expander according to the present embodiment incorporates the reed valve 30*a* attached to the first discharge port 28, and the reed valve 30*a* closes the first discharge port 28 by means of a difference between the pressure Pd applied the discharge chamber 33 and the pressure Pc applied to the operating chamber 25, the operating fluid is prevented from flowing from the discharge chamber 33 into the operating chamber 25. Then, the operating chamber 25 decreases its volume as the rotor 23 rotates, while compression occurs in the operating chamber 25 because the first discharge port 28 is closed by the reed valve 30*a* and the pressure increases following the C-B line in FIG. 2 again. As soon as the pressure applied to the operating chamber 25 exceeds Pd, namely at the point I shown in FIG. 2, the reed valve 30*a* opens for the first time. The process represented by a C-I line is referred to as a recompression process. Thereafter, the operating chamber 25 performs a process for discharging the operating fluid under the pressure Pd on the low pressure side out from the first discharge port 28 while decreasing its volume as the rotor 23 rotates, namely a discharging process.

In the discharging process, a communication to the first discharge port 28 is shut off while the operating chamber 25 moves from the space 25*d* to the space 25*e*. However, the operating fluid is discharged continuously from the operating chamber 25 through the second discharge port 29 because the second discharge port 29 has such a shape that its part contains a position of 315 degrees from the small clearance 22 in the direction where the shaft 26 rotates, namely a position of (360/n) degrees, an interval of the vanes 24, apart circumferentially from the first discharge port 28 assuming that the number of the vanes 24 is n. The discharging process is represented by an I-J line in FIG. 2.

In the present embodiment, by forming two discharge ports 28 and 29, the operating chamber 25 communicates to another second discharge port 29, preventing the operating fluid from being not capable of flowing out from the operating chamber 25 during the discharging process, even when a communication between the operating chamber 25 situated in the space 25*d* and the first discharge port 28 is shut off as the rotor 23 rotates. Note that the first and second discharge ports 28 and 29 may be formed with a gimlet from the outside of the cylinder 21, enabling a vane rotary expander to be provided which is easier to process and requires lower cost compared with the conventional vane rotary expander, in which the opening portion 8*a* of the discharge port 8 is formed on the inner wall 1*a* of the cylinder 1.

The first and second discharge ports 28 and 29 are placed in such a manner that the central angle defined around the shaft 26 on the wall 21*a* of the cylinder 21 between the first and second discharge ports 28 and 29 is (360/n) degrees or less assuming that the number of the vane 24 is n and the second discharge port 29 may contain an area in the vicinity of the small clearance 22. Thus, the operating chamber 25 communicates to at least one of the first and second discharging ports 28 and 29 in the discharging process, preventing a loss due to compression from occurring when the operating chamber 25 becomes an enclosed space during the discharging process.

In addition, by attaching the valve mechanism comprising the reed valve 30*a* and the valve stop 30*b* to the first discharge port 28, the operating fluid is prevented from flowing into the operating chamber 25 from the discharge chamber 33 in the overexpansion process and recompression to the discharge pressure Pd is performed, providing a high-efficiency vane rotary expander without a loss due to expansion (corresponding to an area IHC shown in FIG. 2), which has been found in the conventional vane rotary expanders.

Moreover, since the valve mechanism comprising the reed valve 30*a* and the valve stop 30*b* may be attached only to the first discharge port 28 and not to the second discharge port 29, a high-efficiency vane rotary expander is provided at a lower cost.

Furthermore, by forming the first discharge port 28 at the position of {180×(1+1/n)} degrees from the small clearance 22 in the direction where the shaft 26 rotates, the operating chamber 25 communicates to the first discharge port 28 as soon as the volume of the operating chamber 25 reaches its maximum value, increasing the expansion ratio Rmax.

Accordingly, by actively causing overexpansion while preventing loss due to incomplete expansion, effects of the valve mechanism obtained in the recompression process is used effectively, enabling a high-efficiency vane rotary expander to be provided.

SECOND EMBODIMENT

Figure 3:
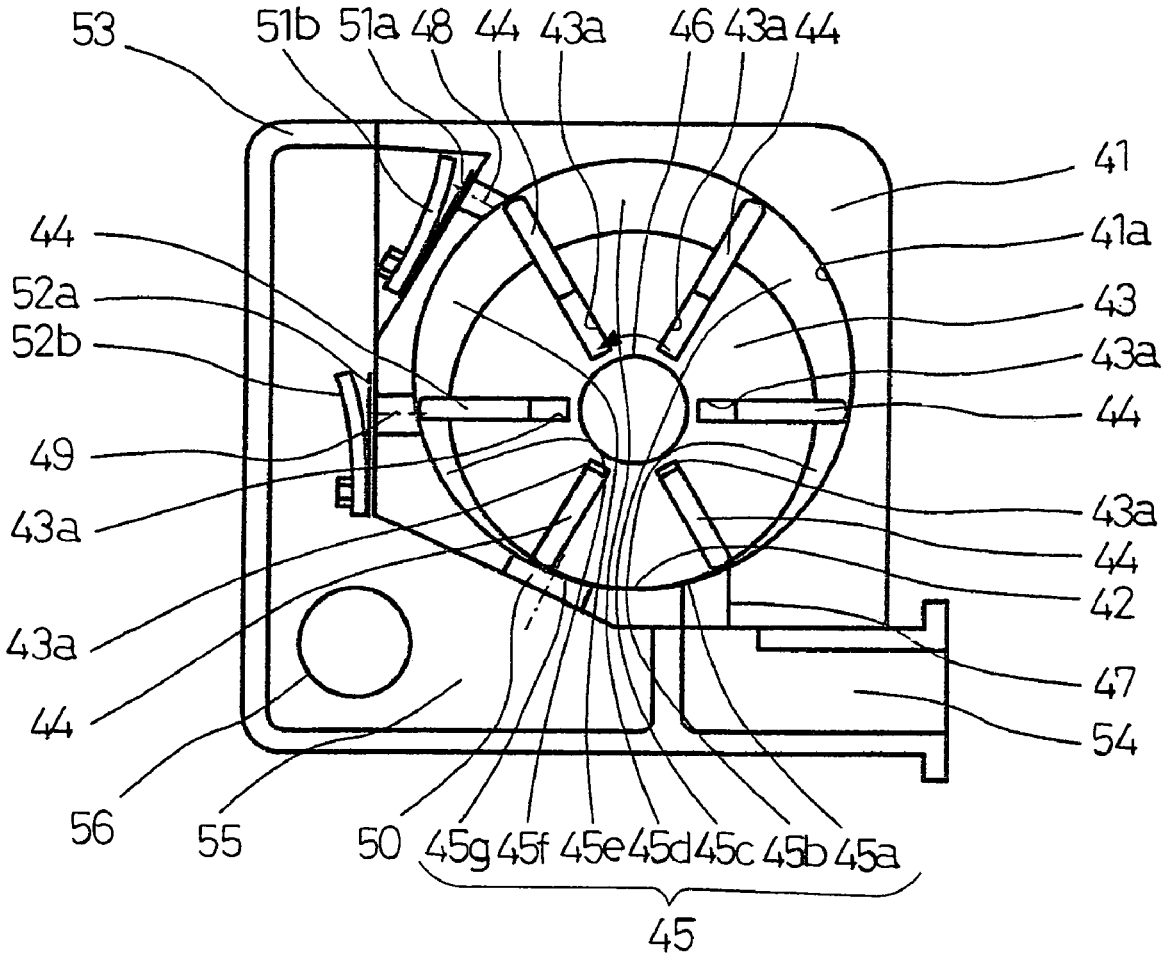
FIG. 3 is a transverse sectional view of a vane rotary expander according to a second embodiment of the present invention.
Figure 4:
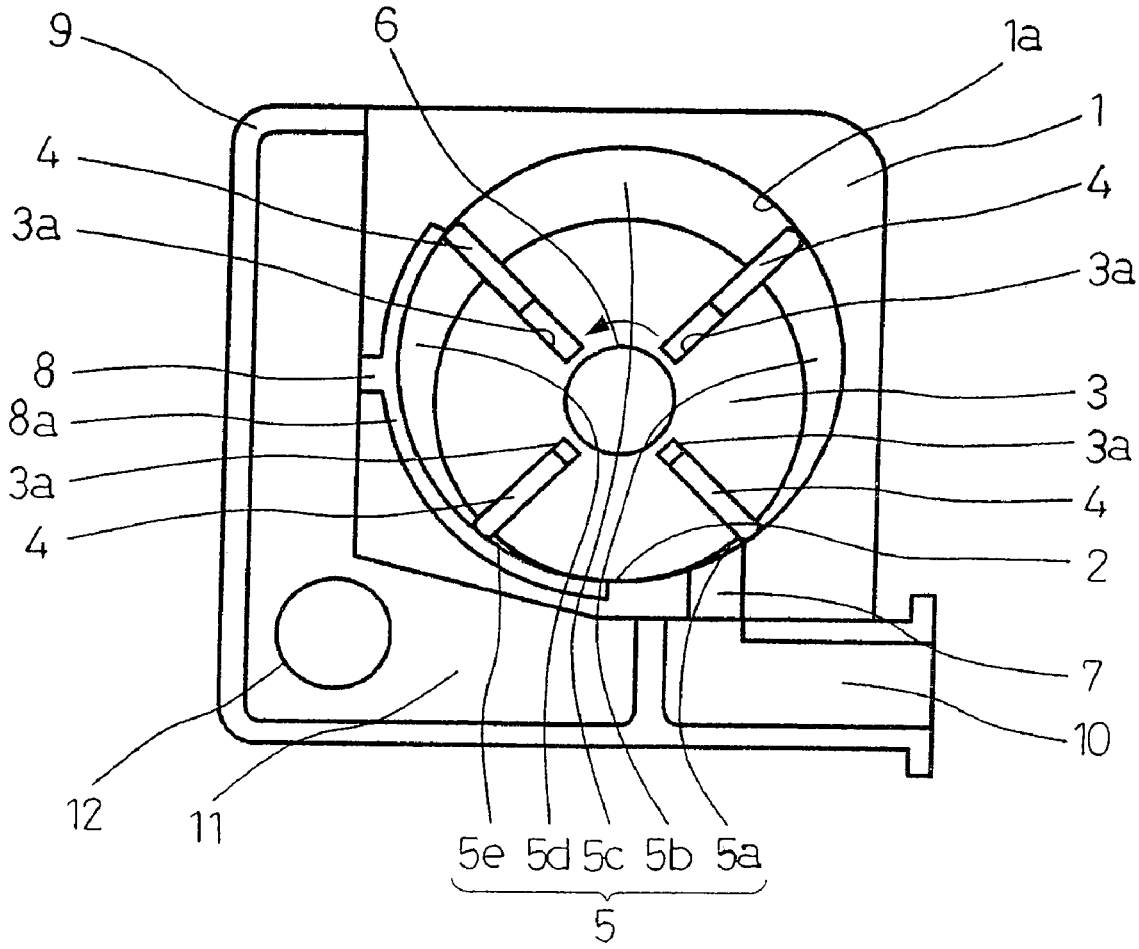
FIG. 4 is a transverse sectional view showing a conventional vane rotary expander.
Figure 5A:
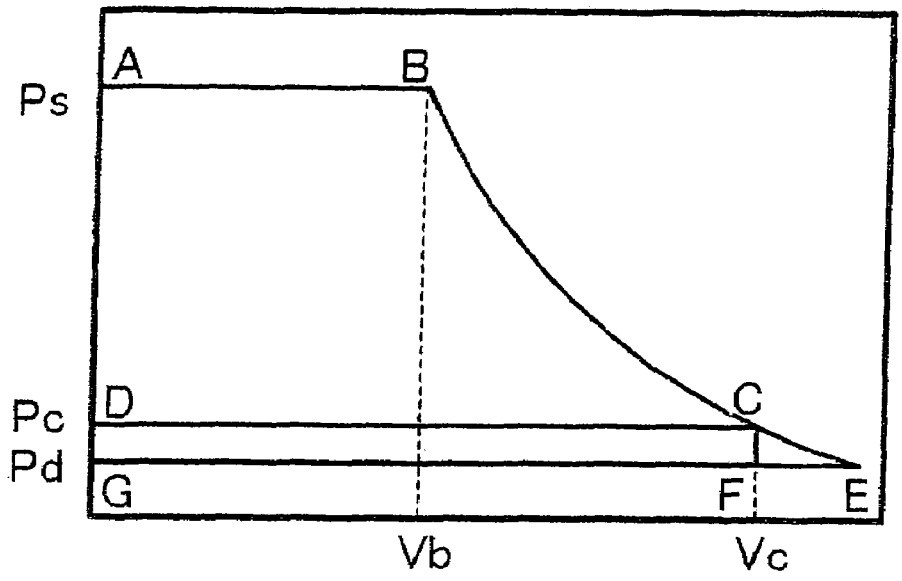
FIGS. 5A and 5B are graphs showing the P-V relationships for the operating chamber of the conventional vane rotary expander.
Figure 5B:
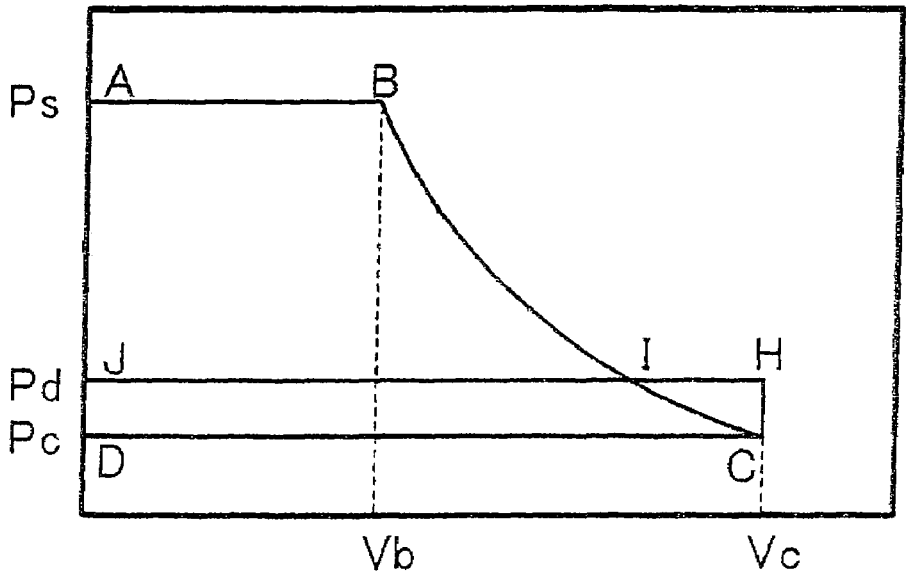
PRIOR ART Fig. 5B

FIG. 3 is a transverse sectional view of a vane rotary expander according to a second embodiment of the present invention. The reference numeral 41 denotes a cylinder having a cylindrical inner wall 41*a* and side plates at its top and bottom ends (not illustrated in the figure). Inside of the cylinder 41, a cylindrical rotor 43 is disposed, and an outer circumferential segment of the cylindrical rotor 43 defines a small clearance 42 together with the inner wall 41*a* of the cylinder 41. The rotor 43 has grooves 43*a* formed perpendicularly to its top and bottom end surfaces at an interval of 60 degrees. Vanes 44 are inserted into the grooves 43*a* at the respective ends thereof so as to be freely slidable, and the other ends of the vanes 44 are in contact with the inner wall 41*a* of the cylinder 41. An operating chamber 45 is formed at spaces 45*a*, 45*b*, 45*c*, 45*d*, 45*e*, 45*f*, and 45*g* surrounded by the inner wall 41*a* of the cylinder 41, the rotor 43, and the vanes 44. A shaft 46 formed integrally with the rotor 43 is rotatably supported about an axis. The cylinder 41 has an intake 47 for guiding an operating fluid into the operating chamber 45 and first, second, and third discharge ports 48, 49, and 50 for flowing the operating fluid out from the operating chamber 45. Similarly to the vane rotary expander according to the first embodiment, the first discharge port 48 is formed at a position of {180.times.(1+1/n)} degrees from the small clearance 42 in the direction where the shaft 46 rotates as indicated by an arrow assuming that the number of the vanes 44 is n. In FIG. 3, the first discharge port 48 is formed at a position of 210 degrees from the small clearance 42 because the number of the vanes 44 is six. In addition, a valve mechanism comprising a reed valve 51*a* and a valve stop 51*b* has been attached to the first discharge port 48. The second discharge port 49 is formed at a position of 270 degrees from the small clearance 42 and has the same type of valve mechanism comprising a reed valve 52*a* and a valve stop 52*b* as that of the first discharge port 48. The third discharge port 50 is formed at a position of 330 degrees with no valve mechanism. Note that the positions of the second and third discharge ports 49 and 50 are not limited to those as described above and may be formed at any position as long as the central angle defined around the shaft 46 on the inner wall 41*a* of the cylinder 41 among the first, second, and third discharge ports 48, 49, and 50 is smaller than or equal to (360/n) degrees assuming that the number of the vanes 44 is n and the third discharge port 50 contains an area in the vicinity of the small clearance 42.

In the present embodiment, similarly to the first embodiment, such a volume ratio is used that overexpansion may occur even at the maximum value for the expansion ratio expected for the system where the vane rotary expander is incorporated.

The operation principle according to the second embodiment is almost the same as that according to the first embodiment, involving the suction, expansion, recompression, and discharging processes with an exception of the number of the vanes 44 being different.

In the second embodiment, when the position of the intake 47 is set at the same position of the intake 27 in the first embodiment by using six vanes 44, the volume ratio (Vd/Vb), a ratio between the volume Vb of the space 45*b*, where the operating chamber 45 is situated immediately after the suction process, and the volume Vd of the space 45*d* where the operating chamber 45 is situated immediately before the discharging process are increased compared with the case where the number of the vanes is four in the first embodiment. For this reason, the vane rotary expander may be incorporated in any system with a larger expansion ratio.

In addition, since three discharge ports 48, 49, and 50 are formed in such a manner that the central angle around the shaft 46 on the inner wall 41*a* of the cylinder 41 among the discharge ports 48, 49, and 50 is smaller than or equal to (360/n) degrees assuming that the number of the vanes 44 is n and the third discharge port 50 is formed in the vicinity of the small clearance 42, the operating chamber 45 communicates to the second discharge port 29 before the communication to the first discharge port 48 is shut off when the chamber 45 is situated in the space 45*e*, and similarly, the operating chamber 45 communicates to the third discharge port 50 before the communication to the second discharge port 49 is shut off. This prevents a loss due to compression from occurring when the operating chamber 45 becomes an enclosed space in the discharging process even when the number of the vanes 44 is six. The first, second, and third discharge ports 48, 49, and 50 may be formed with a gimlet from the outside of the cylinder 41, which is easier to process and requires lower cost compared with the conventional vane rotary expanders, in which the opening portion 8*a* of the discharge port 8 is formed on the inner wall 1*a* of the cylinder 1, enabling a vane rotary expander to be provided at a lower cost.

Note that when the number of vanes is more than six, the same effects may be achieved by increasing the number of discharge ports.

Moreover, by attaching the valve mechanism comprising the lead valve 51*a* and the valve stop 51*b* to the first discharge port 48 and the valve mechanism comprising the lead valve 52*a* and the valve stop 52*b* to the second discharge port 49, respectively, the operating fluid is prevented from flowing into the operating chamber 45 from the discharge chamber 55 in the overexpansion process and the operating fluid is recompressed up to the discharge pressure Pd even when a variation in expansion ratio expected for the system, where the vane rotary expander is incorporated, is large. As a result, a high-efficiency vane rotary expander is provided without a loss due to overexpansion, which has been found in the conventional vane rotary expanders.

Furthermore, in the case where a variation in expansion ratio expected for the system where the expander is incorporated is small, the valve mechanism comprising the lead valve 51*a* and the valve stop 51*b* may be attached only to the first discharge port 48 because overexpansion, a difference between Pd and Pc shown in FIG. 2 is attenuated and the recompression process is shorten (corresponding to the CI line in FIG. 2). This eliminates the need for the lead valve 52*a* and the valve stop 52*b* for the second discharge port 49, enabling a vane rotary expander to be provided at a lower cost.

Note that for the conventional vane rotary expanders, in the case where the operating fluid expands into a gas-liquid two phase from a liquid phase or a supercritical phase, since the density of the operating fluid at the outlet of the expander varies depending on the dryness thereof, the expansion ratio for the expander varies sensitively with the degree of dryness even when the volume ratio remains constant. This is, in particular, likely to cause a loss due to overexpansion or incomplete expansion. Thus, it is clear that the effects of the vane rotary expander of the present invention are far superior to those of the conventional vane rotary expanders.

Further, when an operating fluid containing carbon dioxide as a main component is used, the operating pressure becomes large, resulting in a large pressure difference. As a result, a slight change of the expansion ratio for the system where the expander is incorporated generates significant overexpansion or incomplete expansion. Thus, it is clear that the effects of the vane rotary expander of the present invention are far superior to those of the conventional vane rotary expanders.

INDUSTRIAL APPLICABILITY

As described above, according to the present invention, a plurality of discharge ports are formed in the cylinder in the circumferential direction and the discharge port is provided with a valve mechanism. This prevents the operating fluid from flowing into the operating chamber from the discharge chamber in the overexpansion process, enabling recompression of the operating fluid up to the discharge pressure. Thus, the present invention is suited to provide a high-efficiency vane rotary expander without a loss due to overexpansion, which has been found in the conventional vane rotary expanders.

Furthermore, the present invention is suited to prevent the operating chamber from becoming an enclosed space in the discharging process because it communicates to at least any of the discharge ports, by setting the angles defined between a plurality of discharge ports on the inner wall of the cylinder to the value smaller or equal to (360/n) degrees (where n=the number of the vanes) and placing one of the plurality of discharge ports so that it contains an area in the vicinity of the small clearance.

Furthermore, the present invention is suited to construct a high-efficiency vane rotary expander using the effects of recompression achieved by means of the valve mechanism while preventing a loss due to incomplete expansion from occurring by actively causing overexpansion because the operating chamber communicates to a discharge port immediately after the volume of the operating chamber reaches its maximum value to increase the maximum value for the expansion ratio by forming the discharge ports at a position of $\{180\times(1+1/n)\}$ degrees from the small clearance in the direction where the shaft rotates.

The invention claimed is:

1. A vane rotary expander including:

a cylinder having a cylindrical inner wall;

side plates closing both ends of the cylinder;

a rotor disposed in the cylinder, an outer circumferential segment of the rotor defining a small clearance together with the inner wall of the cylinder;

vanes inserted into vane grooves formed in the rotor at respective ends thereof so as to be freely slidable, the other ends of the vanes being in contact with the inner wall of the cylinder to form a plurality of operating chambers between the cylinder and the rotor; and a shaft integrally formed with the rotor, the shaft being rotatably supported about an axis, wherein a power for rotating the shaft is obtained by expanding a high-pressure operating fluid in the operating chamber, comprising:

a first discharge port firstly communicating to the operating chamber involving in a discharging process and a second discharge port secondly communicating to the same operating chamber, both discharging ports being provided in the cylinder in a circumferential direction;

a valve mechanism preventing the operating fluid from flowing back being provided to the first discharge port; and a discharge chamber temporarily storing the operating fluid flowing out from the first and second discharge ports, wherein:

a pressure (Pc) applied to the operating chamber which has a maximum volume immediately before the operating chamber reaches the first discharge Port is set lower than a pressure (Pd) applied to the discharge chamber, and the expander is set so that the volume of the operating chamber is compressed again immediately after the operating chamber reaches the first discharge port to release the valve mechanism when the recompressed pressure exceeds the pressure applied to the discharge chamber; and a number of the vanes is n, the first discharge port is formed in the cylinder at a position of approximately {180×(1+1/n)} degrees from the small clearance in a direction where the shaft rotates, and the second discharge port is formed in the cylinder at any position in an area from an angle of approximately {180×(1+1/n)} degrees to an angle of 360 degrees from the small clearance in the direction where the shaft rotates.

2. The vane rotary expander according to claim 1, wherein a central angle around the shaft on the cylinder between the first discharge port and the second discharge port and/or between the second discharge ports is smaller than or equal to (360/n) degrees.

3. A vane rotary expander, comprising:

a cylinder having a cylindrical inner wall;

side plates closing both ends of the cylinder;

a rotor eccentrically disposed in the cylinder and an outer circumference of the rotor defining minimum clearance position whereat a clearance between the cylindrical inner wall of the cylinder and the outer circumference of said rotor is minimum;

vanes disposed in vane grooves in the rotor so as to be freely slidable, ends of the vanes being in contact with the cylindrical inner wall of the cylinder to form a plurality of operating chambers between the cylinder and the rotor; and a shaft connected to the rotor and rotatably supported about an axis, a first discharge port which firstly communicates to an operating chamber of said operating chambers during a discharging process and a second discharge port which secondly communicates to the same operating chamber during said discharging processing;

a valve mechanism preventing the operating fluid from flowing back into the operating chamber being provided to the first discharge port;

a discharge chamber temporarily storing the operating fluid flowing out from the first and second discharge ports;

the expander being configured to produce a maximum volume pressure (Pc) in the operating chamber when the operating chamber has a maximum volume immediately before the operating chamber begins communication with the first discharge port, the maximum volume being filled by expansion of the high-pressure operating fluid effecting rotation of said shaft to transmit rotating power;

the expander having a discharge pressure (Pd) in the discharge chamber and the discharge pressure (Pd) being greater than the maximum volume pressure (Pc);

the expander being configured so that the volume of the operating chamber is compressed starting immediately after the operating chamber communicates with the first discharge port and is compressed to a level greater than the discharge pressure (Pd) of the discharge chamber to release the valve mechanism; and the expander having a intake port communicating with the chamber introducing the high-pressure operating fluid into the chamber prior to the chamber expanding to the maximum volume, said intake port being positioned to be out of communication with the operating chamber to end intake of the high pressure operating fluid immediately prior to another operating chamber of said operating chambers, immediately preceding the operating chamber in expansion cycling, reaching the maximum volume.

4. The vane rotary expander according to claim 3, a number of the vanes is n, the first discharge port is formed in the cylinder at a position of approximately {180×(1+1/n)} degrees from the small clearance in a direction where the shaft rotates, and the second discharge port is formed in the cylinder at any position in an area from an angle of approximately {180×(1+1/n)} degrees to an angle of 360 degrees from the small clearance in the direction where the shaft rotates.

5. The vane rotary expander according to claim 4, wherein a central angle around the shaft on the cylinder between the first discharge port and the second discharge port and/or between the second discharge ports is smaller than or equal to (360/n) degrees.

6. An expander having a plurality of operating chambers for expanding a high-pressure operating fluid and a shaft for obtaining a rotating power by expansion of the operating fluid in the operating chambers comprising:

a first discharge port which firstly communicates to an operating chamber of said operating chambers during a discharging process and a second discharge port which secondly communicates to the same operating chamber during said discharging processing;

a valve mechanism preventing the operating fluid from flowing back into the operating chamber being provided to the first discharge port;

a discharge chamber temporarily storing the operating fluid flowing out from the first and second discharge ports;

the expander being configured to produce a maximum volume pressure (Pc) in the operating chamber when the operating chamber has a maximum volume immediately before the operating chamber begins communication with the first discharge port, the maximum volume being filled by expansion of the high-pressure operating fluid effecting rotation of said shaft to transmit rotating power;

the expander having a discharge pressure (Pd) in the discharge chamber and the discharge pressure (Pd) being greater than the maximum volume pressure (Pc);

the expander being configured so that the volume of the operating chamber is compressed starting immediately after the operating chamber communicates with the first discharge port and is compressed to a level greater than the discharge pressure (Pd) of the discharge chamber to release the valve mechanism; and the expander having a intake port communicating with the chamber introducing the high-pressure operating fluid into the chamber prior to the chamber expanding to the maximum volume, said intake port being positioned to be out of communication with the operating chamber to end intake of the high pressure operating fluid immediately prior to another operating chamber of said operating chambers, immediately preceding the operating chamber in expansion cycling, reaching the maximum volume.

7. The vane rotary expander according to any one of claims 1, 2, 3, 6, wherein the expander is operated by the operating fluid expanding into a gas-liquid two phase from a liquid phase or a supercritical phase.

8. The vane rotary expander according to any one of claims 1, 2, 3, 6, wherein the expander is operated by the operating fluid containing carbon dioxide as a main component.

9. A vane rotary expander including:

a cylinder having a cylindrical inner wall;

side plates closing both ends of the cylinder;

a rotor disposed in the cylinder, an outer circumferential segment of the rotor defining a small clearance together with the inner wall of the cylinder;

vanes inserted into vane grooves formed in the rotor at respective ends thereof so as to be freely slidable, the other ends of the vanes being in contact with the inner wall of the cylinder to form a plurality of operating chambers between the cylinder and the rotor; and a shaft integrally formed with the rotor, the shaft being rotatably supported about an axis, wherein a power for rotating the shaft is obtained by expanding a high-pressure operating fluid in the operating chamber, comprising:

a first discharge port firstly communicating to the operating chamber involving in a discharging process and a second discharge port secondly communicating to the same operating chamber, both discharging ports being provided in the cylinder in a circumferential direction;

a valve mechanism preventing the operating fluid from flowing back being provided to the first discharge port; and a discharge chamber temporarily storing the operating fluid flowing out from the first and second discharge ports, wherein:

a pressure (Pc) applied to the operating chamber which has a maximum volume immediately before the operating chamber reaches the first discharge port is set lower than a pressure (Pd) applied to the discharge chamber, and the expander is set so that the volume of the operating chamber is compressed again immediately after the operating chamber reaches the first discharge port to release the valve mechanism when the recompressed pressure exceeds the pressure applied to the discharge chamber; and the expander is operated by the operating fluid expanding into a gas-liquid two phase from a liquid phase or a supercritical phase.

10. A vane rotary expander including:

a cylinder having a cylindrical inner wall;

side plates closing both ends of the cylinder;

a rotor disposed in the cylinder, an outer circumferential segment of the rotor defining a small clearance together with the inner wall of the cylinder;

vanes inserted into vane grooves formed in the rotor at respective ends thereof so as to be freely slidable, the other ends of the vanes being in contact with the inner wall of the cylinder to form a plurality of operating chambers between the cylinder and the rotor; and a shaft integrally formed with the rotor, the shaft being rotatably supported about an axis, wherein a power for rotating the shaft is obtained by expanding a high-pressure operating fluid in the operating chamber, comprising:

a first discharge port firstly communicating to the operating chamber involving in a discharging process and a second discharge port secondly communicating to the same operating chamber, both discharging ports being provided in the cylinder in a circumferential direction;

a valve mechanism preventing the operating fluid from flowing back being provided to the first discharge port; and a discharge chamber temporarily storing the operating fluid flowing out from the first and second discharge ports, wherein:

a pressure (Pc) applied to the operating chamber which has a maximum volume immediately before the operating chamber reaches the first discharge port is set lower than a pressure (Pd) applied to the discharge chamber, and the expander is set so that the volume of the operating chamber is compressed again immediately after the operating chamber reaches the first discharge port to release the valve mechanism when the recompressed pressure exceeds the pressure applied to the discharge chamber; and the expander is operated by the operating fluid containing carbon dioxide as a main component.

11. An expander for producing rotary motion from fluid expansion, comprising:

a housing structure defining a cylindrical cavity having a cylindrical inner wall;

a rotor eccentrically disposed in and with respect to the cylindrical cavity and having an outer circumference of the rotor defining minimum clearance position whereat a clearance between the cylindrical inner wall of the cylinder and the outer circumference of the rotor is minimum, said rotor defining vane grooves;

vanes slidably disposed in said vane grooves and having vane ends contacting the cylindrical inner wall to form a plurality of operating chambers between the cylinder and the rotor which rotate, and expand and contract in volume with rotation of the rotor;

a shaft connected to the rotor and rotatably supporting said rotor;

an intake port disposed in said housing structure, having high-pressure fluid applied thereto, and successively introducing said high-pressure fluid into said operating chambers during a suction process, said operating chambers increasing in volume during said suction process to a volume Vb at a point whereat communication with said intake port ceases;

said high-pressure fluid expanding in said operating chambers to expand said operating chambers to rotate said rotor and expand the operating chambers to a maximum volume Vc;

said intake port being positioned to end communication with said operating chambers when an immediately preceding one of said operating chambers expands to the maximum volume Vc;

a first discharge port disposed in said housing structure which firstly communicates to said operating chambers during a discharging process and a second discharge port which secondly communicates to said operating chambers during said discharging processing, said first and second discharge ports being disposed such that as the rotor rotates, the first discharge port communicates with a given chamber of said plurality of chamber and the second discharge port subsequently communicates with said given chamber while said first discharge port is still in communication with said given chamber and also after said first discharge port ceases being in communication with said given chamber;

a valve mechanism preventing fluid from flowing back into the operating chambers being provided to the first discharge port;

the first and second discharge ports having an external discharge pressure (Pd) and the discharge pressure (Pd) being greater than a pressure (Pc) of expanded fluid in the operating chambers at the maximum volume Vc; and the first discharge port being positioned so that the operating chambers are compressed starting immediately after the operating chambers communicate with the first discharge port and are compressed to provide a pressure a level greater than the discharge pressure (Pd) to open the valve mechanism.

12. The expander of claim 11 wherein said intake port being positioned to define the volume Vb such that $$Vb=Vc\times(1/R\max)^{1/\kappa}$$

wherein Rmax is a maximum expansion ratio of the high-pressure fluid and κ diabetic coefficient.

13. The expander according to claim 12, wherein a number of the vanes is n, the first discharge port is formed in the housing structure at a position of approximately {180×(1+1/n)} degrees from the minimum clearance position in a rotation direction of the rotor, and the second discharge port is formed in the housing structure at any position in an area from an angle of approximately {180×(1+1/n)} degrees to an angle of 360 degrees from the minimum clearance position in the rotation direction.

14. The expander according to claim 13, wherein an angle subtended by the first discharge port and the second discharge port is smaller than or equal to (360/n) degrees.

15. The expander according to claim 12, further comprising a plurality of second discharge ports including said second discharge port and an angle subtended by the first discharge port and a furthest one of the second discharge ports is smaller than or equal to (360/n) degrees.

16. The expander according to claim 12, wherein the high-pressure fluid expands into a gas-liquid two phase from a liquid phase or a supercritical phase.

17. The expander according to claim 12, wherein the high-pressure fluid includes carbon dioxide as a main component.

18. The expander according to claim 11, wherein an angle subtended by the first discharge port and the second discharge port is smaller than or equal to (360/n) degrees.

19. The expander according to claim 11, further comprising a plurality of second discharge ports including said second discharge port and an angle subtended by the first discharge port and a furthest one of the second discharge ports is smaller than or equal to (360/n) degrees.

20. The expander according to claim 11, wherein the high-pressure fluid expands into a gas-liquid two phase from a liquid phase or a supercritical phase.

* * * * *